US007631466B2

(12) United States Patent
Black

(10) Patent No.: US 7,631,466 B2
(45) Date of Patent: Dec. 15, 2009

(54) METHODS AND APPARATUS FOR CONTROLLING MOISTURE IN STRAW BALE CORE WALLS

(75) Inventor: Roy Gary Black, El Cerrito, CA (US)

(73) Assignee: Integrated Structures, Inc., Berkeley, CA (US)

( * ) Notice: Subject to any disclaimer, the term of this patent is extended or adjusted under 35 U.S.C. 154(b) by 0 days.

(21) Appl. No.: 12/229,885

(22) Filed: Aug. 27, 2008

(65) Prior Publication Data

US 2009/0031654 A1 Feb. 5, 2009

Related U.S. Application Data

(63) Continuation-in-part of application No. 10/775,714, filed on Feb. 10, 2004, now Pat. No. 7,461,486.

(51) Int. Cl.

| | |
|---|---|
| ***E04B 1/00*** | (2006.01) |
| ***E04C 2/52*** | (2006.01) |
| ***E04C 1/00*** | (2006.01) |
| ***E04F 17/00*** | (2006.01) |

(52) U.S. Cl. ..... 52/250; 52/302.1; 52/309.12; 52/DIG. 9; 52/220.1

(58) Field of Classification Search ..... 52/250, 52/302.1, 83, 561, 309.12, DIG. 9, 220.1–220.8; 454/182, 136

See application file for complete search history.

(56) References Cited

U.S. PATENT DOCUMENTS

| | | | | |
|---|---|---|---|---|
| 4,048,911 | A * | 9/1977 | Petersen | 454/136 |
| 4,214,511 | A * | 7/1980 | Mueller | 454/182 |
| 6,038,820 | A * | 3/2000 | Rainbolt | 52/83 |
| 6,061,986 | A * | 5/2000 | Canada | 52/561 |
| 6,263,623 | B1 * | 7/2001 | Weiss et al. | 52/200 |
| 6,385,932 | B1 * | 5/2002 | Melchiori | 52/302.3 |
| 6,494,006 | B2 * | 12/2002 | Rainbolt | 52/302.1 |
| 6,560,940 | B2 * | 5/2003 | Mueller | 52/295 |

OTHER PUBLICATIONS

R. Gary Black, Spar and Membrane Structure, The Last Straw, Winter 1997, pp. 10-11, No. 17, published out of Tucson, AZ.

* cited by examiner

*Primary Examiner*—Richard E Chilcot, Jr.
*Assistant Examiner*—Mark R Wendell
(74) *Attorney, Agent, or Firm*—H. Michael Brucker

(57) ABSTRACT

A moisture control system for a straw bale core wall having an air pathway from the foundation of the wall to its bond beam permitting air to be pumped into the wall at the foundation level and up through the core of the wall into a plenum space at the top of the wall and out through one or more vents into the atmosphere.

10 Claims, 4 Drawing Sheets

METHODS AND APPARATUS FOR CONTROLLING MOISTURE IN STRAW BALE CORE WALLS

BACKGROUND OF THE INVENTION

The present invention relates to building structures and, in particular, to building structures employing straw bales as the core material for structural walls.

The use of straw bales as a core material for structural walls has been known for many years. Straw bales are stacked to the desired height of the wall and then covered with a membrane such as concrete. The straw bales provide a construction form and excellent insulation.

While the several advantages of straw bale core walls are well known to those skilled in the art, it is equally well known that moisture in the straw is a major concern. If uncontrolled, moisture buildup in such walls can lead to mold and rotting that can require that the walls be opened and the straw replaced. The present invention provides methods and apparatus for preventing the buildup of moisture in the core of a straw bale wall, as well as means for allowing moisture in the straw to travel out of the wall.

BRIEF DESCRIPTION OF THE INVENTION

The present invention addresses the problem of moisture in the straw bales of a straw bale core wall by providing an escape route for moisture that travels by gravity to the bottom of the wall, as well as moisture that travels upward in the wall as a result of evaporation. In addition, the invention provides structures preventing moisture from entering the wall at the level of the foundation.

At the foundation level, a step is provided in the foundation wall at the location of the exterior membrane to prevent exterior-borne water from entering the wall cavity. In addition, at the foundation level, a combination capillary break and moisture sink is provided to prevent wicking of moisture into the wall cavity and provide a way for excess moisture buildup to exit the wall.

At the top of the wall, a vented plenum is provided to capture evaporating moisture and direct it out of the wall structure.

The combination of a foundation level moisture control and a bond beam level moisture control creates a system that keeps the moisture in the straw at acceptable levels.

Accordingly, it is an object of the present invention to provide a moisture control system for a straw bale core wall.

It is another object of the invention to provide a sump and escape path for water that is driven by gravity to the bottom of a straw bale core wall.

It is yet another object of the invention to provide a space above the bales of a straw bale core wall for accumulating moisture of evaporation and vents from that space which allow the evaporation moisture to escape the wall.

The foregoing and other objectives, features and advantages of the invention will be more readily understood upon consideration of the following detailed description of the invention taken in conjunction with the accompanying drawings.

DETAILED DESCRIPTION OF THE PREFERRED EMBODIMENTS

Figure 1:
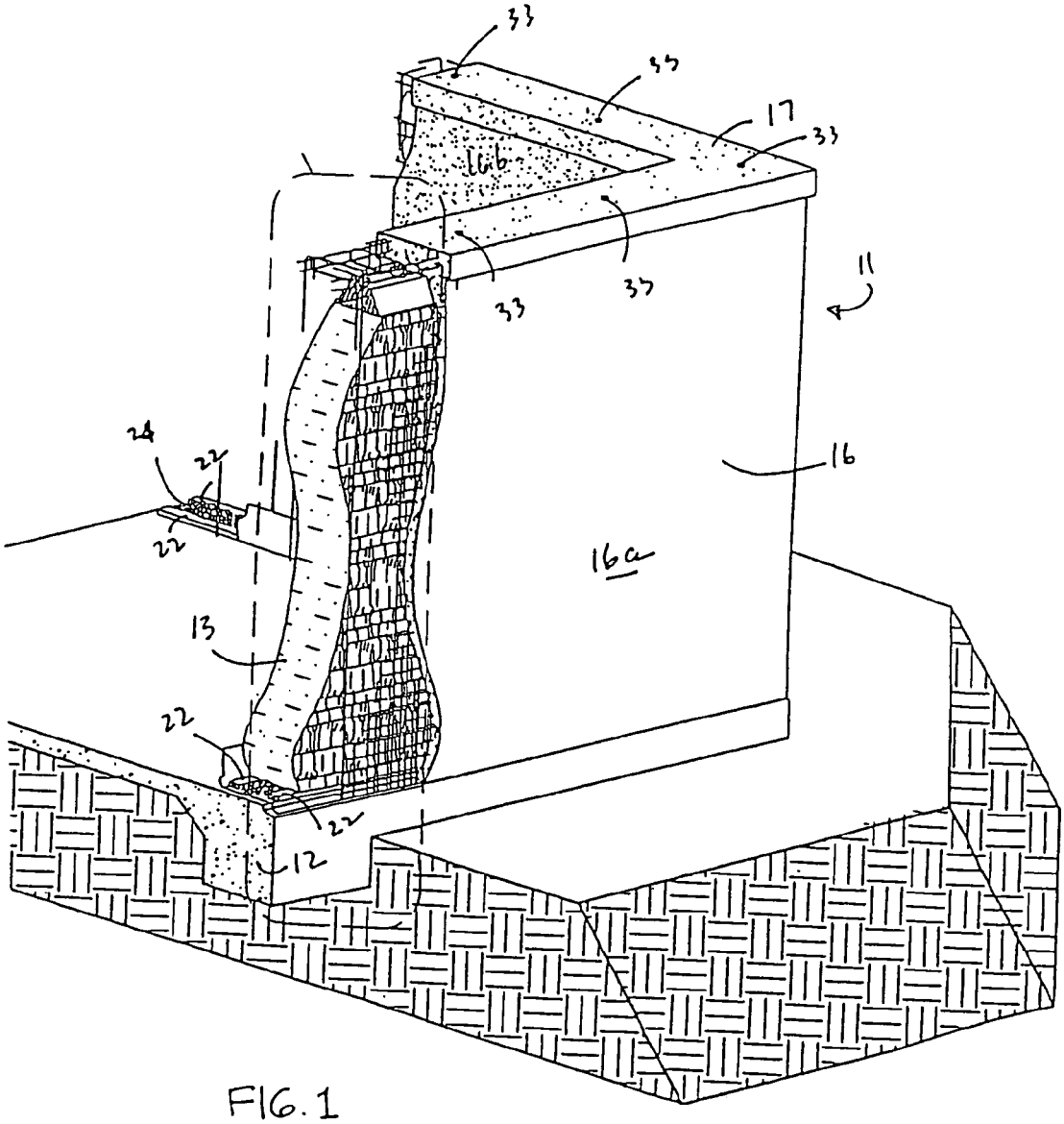
FIG. 1 is a perspective view of a partial straw bale core wall with portions broken away to expose certain parts of the external structure of the wall and foundation.
Figure 2:
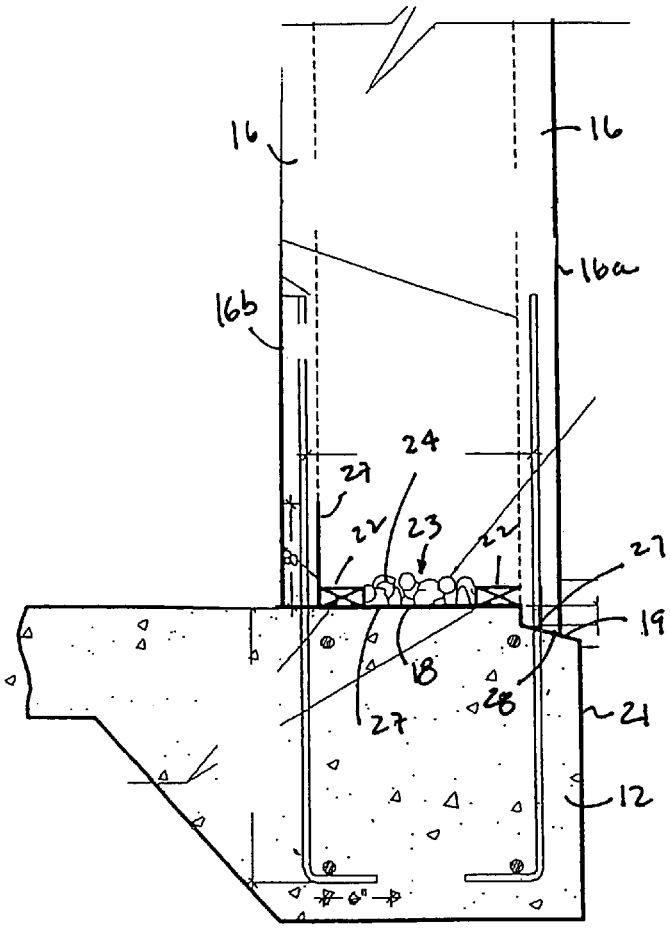
FIG. 2 is an end view of the foundation illustrating the water sump created at the level of the foundation.
Figure 3:
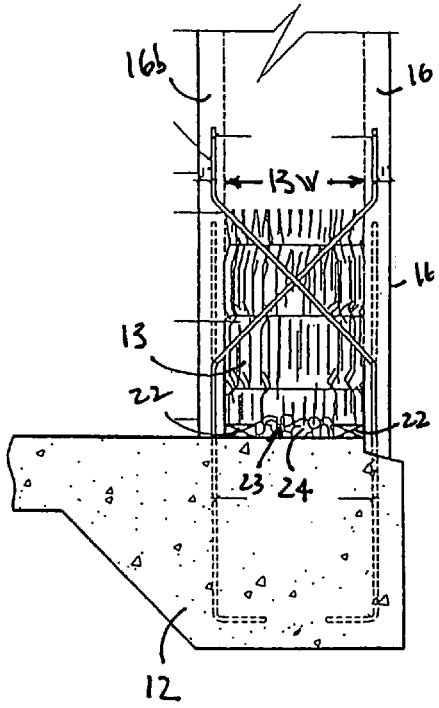
FIG. 3 is the same as FIG. 2, with the addition of a straw bale.
Figure 4:
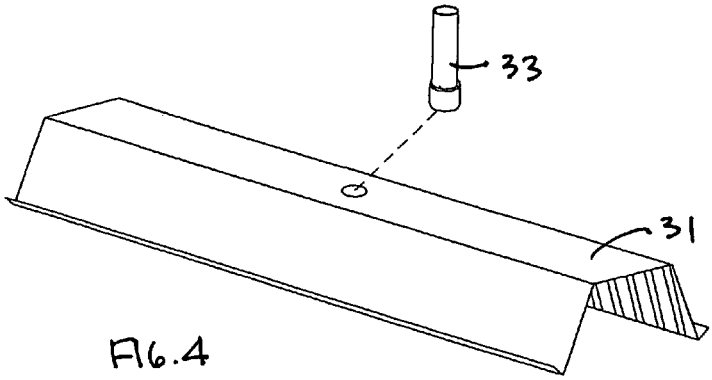
FIG. 4 is a perspective view of a plenum and vent pipe.
Figure 5:
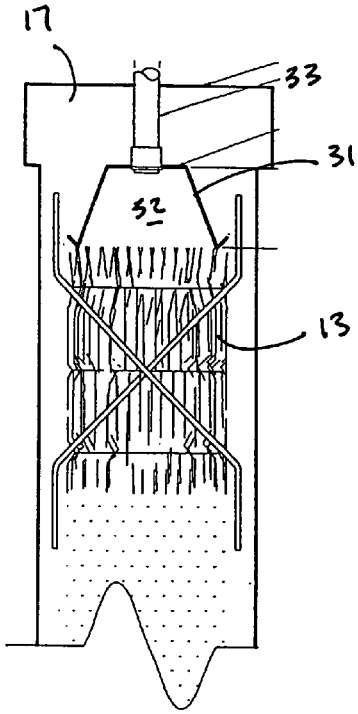
FIG. 5 is an end view of the top portion of a wall showing the plenum between the top row of straw bales and the bond beam.
Figure 6:
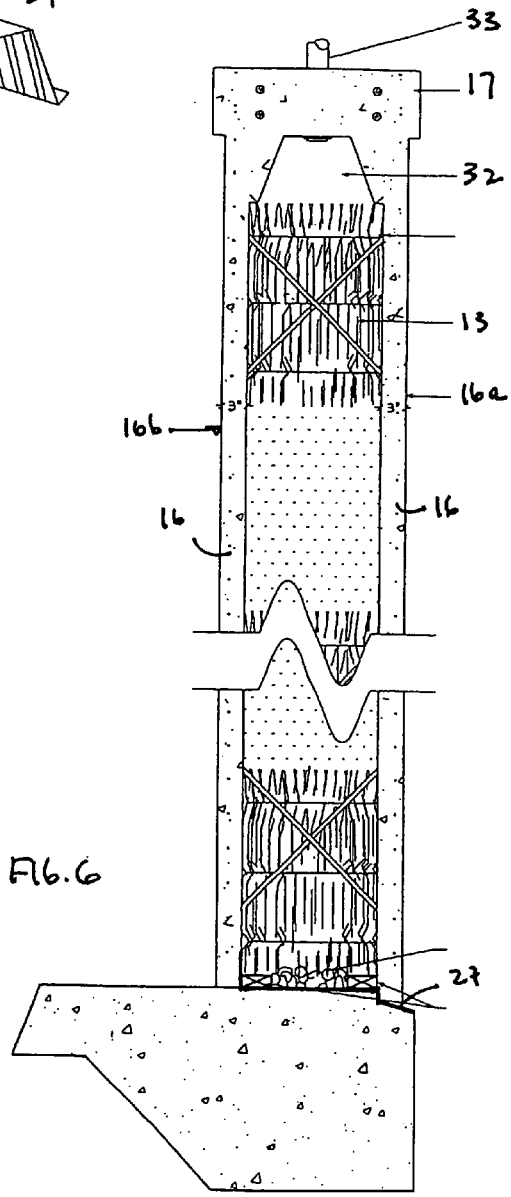
FIG. 6 is an end view illustrating the foundation level and bond beam level of a wall after the membrane has been applied.

Referring to FIGS. 1, 2 and 3, a plurality of stacked straw bales 13 form the core of a wall 11 that is built on a foundation wall 12. In the finished wall 11, straw bales 13 are encapsulated by a membrane 16, typically of concrete (shotcrete or gunnite, for example), forming an exterior wall surface 16*a* and an interior wall surface 16*b*. The wall is capped by a bond beam 17 which connects the two wall surfaces 16*a* and 16*b*.

The foundation wall 12 has a generally flat horizontal surface 18 which supports the weight of bales 13. A step 19 coextensive with wall 12 is below horizontal surface 18 and angled downwardly away from the foundation wall. In the preferred embodiment of the invention, the step 19 is integral with the foundation wall 12.

A pair of spaced-apart plates (runners) 22 are attached to and run along the length of foundation wall 12 on its horizontal surface 18. Plates 22 can, for example, be made from lengths of pressure-treated wood 2'×4's or composite materials in 2'×4' (or like dimensions) lengths. The runners 22 are preferably positioned at the edges of the horizontal surface 18 and spaced apart a distance less than the width 13W of a straw bale 13 (see FIG. 3). A channel 23 formed by and between the runners 22 is filled with drain rock 24 or other suitable material for maintaining a fluid path through channel 23. As best seen in FIGS. 1 and 3, the bales 13 stacked onto foundation 12 sit on runners 22 above channel 23 and the drain rock 24.

Prior to placing the runners 22 and drain rock 24 onto the horizontal surface 18 of foundation wall 12, it is advisable to lay a sheet of waterproof material 27 over horizontal surface 18 of foundation wall 12 and extend it onto the step 19 and vertically above the plate 22 nearest the interior surface 16*b* of membrane 16.

Typically, the membrane 16 is concrete applied as shotcrete or gunnite to a thickness of approximately 3 inches. In the preferred embodiment, the step 19 extends a little more than 3 inches away from the edge of horizontal surface 18 and is, therefore, largely covered after the membrane 16 is added. The cold joint 28 between step 19 and membrane 16 creates a path for water. By angling step 19 downwardly away from foundation 12, any water that runs off the exterior surface 16*a* of wall 11 will be prevented from intruding into the wall and adding moisture to the straw bales 13. At the same time, the cold joint 28 provides an escape path for moisture in the straw bales 13, which gravity deposits into channel 23 through the drain rock 24. Thus, while exterior water cannot travel uphill to the interior of wall 11, water that drains from the bales 13 has a downhill escape route via cold joint 28.

Referring to FIGS. 1, 4, 5 and 6, a U-shaped plenum 31, preferably formed from galvanized sheet metal, is placed, open side down, on the top of the stack of bales 13, preferably along the entire length of the wall. When the bond beam 17 is formed on the top of wall 11, the plenum 31 maintains an open space 32 between the bond beam 17 and the uppermost bales 13.

Vent pipes 33 penetrate the sheet metal plenum 31 at spaced-apart locations along the length of the wall 11 and extend through the bond beam 17. The vent pipes 33 communicate the plenum space 32 with an airspace exterior to the wall 11, which may be into an attic space or out of the building altogether. What is important is that the plenum space 32 collects the evaporating moisture coming from bales 13 and vent pipes 33 provide a path for the moisture to be carried away from the interior of wall 11.

Thus, the moisture control system of the present invention provides a sump into which moisture driven by gravity can collect at the level of the foundation which supports the bale core and from which it can exit through a water path communicating with the exterior of the wall. Similarly, moisture in the form of evaporation is collected in an airspace above the stack of bales 13 and provided with an exit route out of the wall structure. In addition, the juncture of the foundation step 19 and the membrane 16 prevents water from entering the core of wall 11 at the location of the foundation 12. Together, a novel system is formed that maintains the moisture level within the wall below that which can lead to difficulties.

Figure 7:
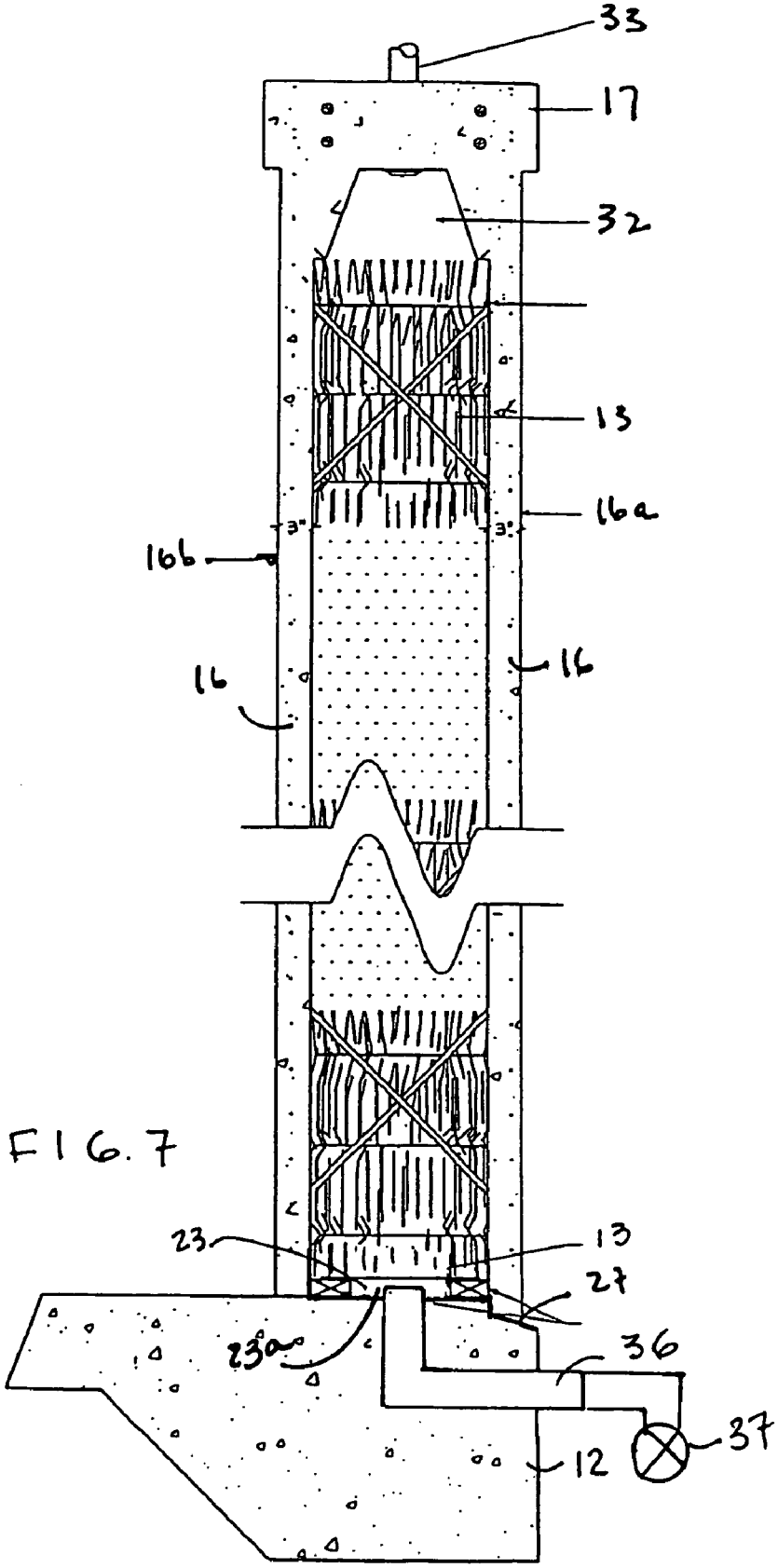
FIG. 7 is the same as FIG. 6 illustrating an alternative embodiment.

Referring to FIG. 7, in an alternative embodiment, the channel 23 is left essentially empty rather than being filled with drain rock providing an air space 23*a* between the foundation wall 12 and the lowermost bales 13. One or more conduits 36 that extend from the exterior of the wall 11 to the channel air space 23*a* provide a means by which air or other gasses can be pumped, as by a pump 37, into the interior of wall 11. In one embodiment, as shown, the conduit 36 is disposed in the foundation wall 12.

The plenum air space 32 and vent pipe 33 (described above), together with the conduit 36, permit air (or other materials) to be pumped into the space 23*a* below the bales 13 and travel up the wall 11 through the straw bales 13 and into the plenum 32 and then into the atmosphere by way of vent 33. Warm air can be pumped into wall 11 to dry moist wall filler such as bales 13 and can include chemicals that can retard mold or other deleterious conditions in the straw.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A system for controlling moisture in a building wall having stacked straw bales at its core comprising:

a foundation wall having a generally horizontal top surface;

a plurality of straw bales having a width stacked above said foundation wall providing a core for the wall wherein the stacked bales have uppermost bales and lowermost bales; and a channel air space between the horizontal surface of said foundation wall and said lowermost straw bales;

an interior membrane covering the bales on one side of the wall and extending above the uppermost bales;

an exterior membrane covering the bales on the other side of said wall and extending above the uppermost bales;

a wall bond beam spaced apart from the uppermost bales creating an enclosed plenum air space within the building wall above the uppermost bales and between said interior membrane and said exterior membrane at the top of the wall; and a conduit extending from outside of the wall to said channel air space.

2. The system of claim 1 further comprising:

a plenum member disposed on the uppermost bale and in the enclosed plenum air space.

3. The system of claim 2 wherein said plenum member is a U-shaped galvanized metal member with its open side facing said uppermost bales and supported thereby.

4. The system of claim 3 further comprising:

at least one vent in said plenum member communicating said enclosed plenum air space with airspace exterior to the wall.

5. A system for controlling moisture in a building wall having stacked straw bales at its core comprising:

a foundation wall having a generally horizontal top surface;

a plurality of straw bales stacked above said foundation wall providing a core for the building wall, said stacked bales having lowermost bales and uppermost bales;

a channel air space between said foundation wall and said lowermost bales;

a plenum air space above said uppermost bales; and a conduit communicating said channel air space with an air space outside of the wall.

6. The system of claim 5 further comprising:

a plenum member disposed on the uppermost bale and in the plenum air space.

7. The system of claim 6 wherein said plenum member is a U-shaped galvanized metal member with its open side facing said straw bales and supported thereby.

8. The system of claim 6 further comprising at least one vent in said plenum member communicating said enclosed plenum air space with airspace exterior to the wall.

9. A method of controlling moisture in a vertical wall having a core of straw bales stacked on a foundation wall, the steps comprising;

creating a channel air space between the foundation wall and the stacked bales, creating an enclosed plenum airspace within and at the top of the wall above the stacked bales;

venting said enclosed plenum airspace; and creating a communication duct between the channel air space and an air space outside of the wall.

10. The method of claim 9 further comprising pumping a gas into the channel air space via the communication duct.

* * * * *